United States Patent [19]

Fogo et al.

[11] 4,081,346

[45] Mar. 28, 1978

[54] HORIZONTAL OSCILLATING TREATING BARREL APPARATUS

[75] Inventors: Denis S. Fogo, Manzini, Swaziland; Roy W. Skaggs, Jr., Mt. Clemens, Mich.

[73] Assignee: Oxy Metal Industries Corporation, Detroit, Mich.

[21] Appl. No.: 793,386

[22] Filed: May 3, 1977

[51] Int. Cl.[2] ..... C25D 17/20; B01F 9/02

[52] U.S. Cl. ..... 204/213; 366/204; 366/234

[58] Field of Search ..... 204/213, 214; 259/89

[56] References Cited

U.S. PATENT DOCUMENTS

| | | | |
|---|---|---|---|
| 3,663,410 | 5/1972 | Schumacher | 204/213 |
| 3,668,103 | 6/1972 | Singleton | 204/213 |
| 3,674,673 | 7/1972 | Jessup | 204/213 |
| 3,769,193 | 10/1973 | Gill | 204/213 |

*Primary Examiner*—F.C. Edmundson

*Attorney, Agent, or Firm*—Harness, Dickey & Pierce

[57] ABSTRACT

An improved barrel-type treating apparatus comprising a framework, a foraminous treating barrel having an elongated opening supported at its ends on the framework, and a drive mechanism including a shaft on the framework having a driven gear at one end drivingly coupled to the barrel, a drive gear at the opposite end coupled to the shaft through a slip clutch and a stop arm on the shaft for engaging an abutment at a treating station to limit oscillating movement of the barrel between an angularity of preferably at least about 180° up to an angularity below that at which workpieces are inadvertently discharged from the barrel opening. The gear on the barrel is preferably provided with coacting means to prevent loss of synchronization between the barrel and drive assembly. A secondary drive assembly is also preferably provided for oscillating the barrel through a controlled angularity while in an elevated position above a treating station to facilitate drainage of treating solution from the workpieces.

20 Claims, 17 Drawing Figures

HORIZONTAL OSCILLATING TREATING BARREL APPARATUS

BACKGROUND OF THE INVENTION

The apparatus of the present invention comprises a further improvement over the horizontal oscillating barrel apparatus as disclosed in U.S. Pat. No. 3,674,673 of July 4, 1972, for "Apparatus for Electroplating Workpieces", which is also assigned to the assignee of the present invention. The apparatus as disclosed in the aforementioned patent, the substance of which is incorporated herein by reference, constituted a major breakthrough in the treatment of bulk quantities of workpieces over conventional prior art type rotating treating barrels which generally were of a polygonal cross sectional configuration, such as a hexagonal configuration, for example, and further included a removable door panel for gaining access to the interior of the barrel. The improved efficiency and load-carrying capacity of horizontal oscillating type treating barrels of the type to which the present invention is directed has occasioned a widespread commercial acceptance thereof in view of the economies provided and their increased adaptation to automatic processing of bulk quantities of small workpieces.

In accordance with the apparatus as disclosed in the aforementioned U.S. Pat. No. 3,674,673, a control of the angular oscillation of the barrel is achieved by providing stops on one of the end members of the barrel adapted to coact with an abutment on the carrier framework, thereby restricting angular oscillation of the barrel beyond a position at which workpieces are inadvertently discharged from the elongated opening formed in the foraminous barrel wall extending between the opposite end members. The present invention provides for an improved stop arrangement for controlling the angularity of oscillation of the barrel while immersed in a liquid treating solution, as well as while the barrel is disposed in an elevated position so as to facilitate drainage of entrapped treating solution from the interior of the barrel and the workpieces therein. The improved drive and stop arrangement minimizes exposure and contact of the drive gear with the fumes and liquid solutions associated in the processing of workpieces through various chemical and electrochemical treatment steps, such as through a cleaning, electroplating and rinsing operation, thereby providing for improved control and further increasing the durability of the barrel-type treating apparatus. The present invention further provides for an improved treating barrel work carrier of the horizontal oscillating type, whereby an improvement is effected in the manner by which the barrel is supported for rotary movement from the carrier framework, eliminating torsional forces on the framework and further including a novel bearing arrangement providing for increased durability and facilitating periodic maintenance and replacement of the bearing assembly.

SUMMARY OF THE INVENTION

The benefits and advantages of the present invention are achieved by an apparatus for treating workpieces in bulk comprising a foraminous treating barrel supported at its ends by a framework and including a drive mechanism positioned at a treating station for engaging and oscillating the barrel through a controlled angularity to impart a tumbling action to the workpieces while they are immersed in a liquid treating solution. The treating barrel comprises a foraminous body member extending between a pair of spaced end members defining in combination a substantially cylindrically-shaped chamber for receiving the workpieces to be treated. The body member is formed with an elongated opening extending between the end members through which the workpieces are introduced into and discharged from the treating chamber. The body member is further provided with at least one inwardly projecting tumbling rib disposed substantially diametrically opposite to the elongated opening for imparting a cascading action to the workpieces in response to oscillatory movement of the barrel.

One of the end members of the barrel is formed with a circular gear which is disposed in meshing relationship with a driven gear affixed to a shaft on the carrier framework including an engaging arm affixed thereto, which is operatable to engage a coacting abutment located at a treating receptacle for controlling oscillation of the barrel between an angularity preferably of at least about 180° up to an angularity below that at which workpieces are inadvertently discharged from the elongated barrel opening. The drive shaft further includes a drive gear coupled thereto through a slip clutch and which is adapted to be disposed in driven relationship with a drive mechanism disposed adjacent to a treating station. The drive gear is also adapted to be disposed in driving connection with a secondary drive mechanism on a conveying apparatus adapted to transport the barrel-type work carriers between the several treating stations when the work carrier is in an elevated position so as to impart an oscillating movement thereto, facilitating a drainage of treating solution from the workpieces and the interior of the barrel. The engaging arm on the drive shaft is provided with a second engaging lug for coacting with a stop abutment on the conveyor carriage to similarly restrict the angularity of oscillating movement of the barrel while in the elevated position to prevent inadvertent discharge of the workpieces from the opening in the barrel.

The circular gear on one end member of the barrel and the driven gear are further provided with coacting stop means to prevent relative rotation thereof beyond a specific angular position to prevent the driven gear and the circular barrel gear from moving out of synchronization relative to each other during such times that the barrel is at an automatic load and unload station at which position the barrel is permitted to oscillate in the absence of any coacting abutment beyond the normal angular disposition so as to effect a discharge or dumping of the workpieces from the interior chamber thereof.

The work carrier itself embodies an improved treating barrel and supporting arrangement, whereby the ends of the barrel are integrally formed with axially projecting shafts which extend into bores provided in the lower end portion of the barrel hangers on the carrier framework and which further include a flange type half bearing in which the barrel shafts are rotatably journaled.

Additional benefits and advantages of the present invention will become apparent upon a reading of the description of the preferred embodiments taken in conjunction with the accompanying drawings.

DESCRIPTION OF THE PREFERRED EMBODIMENTS

Figure 1:
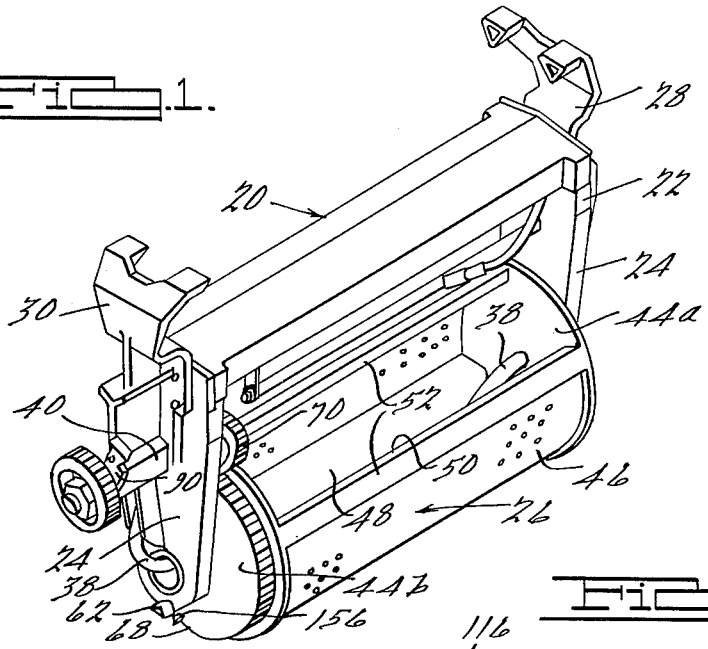
FIG. 1 is a perspective view of a work carrier including a horizontal oscillating barrel and drive shaft arrangement in accordance with a preferred embodiment of the present invention.
Figure 2:
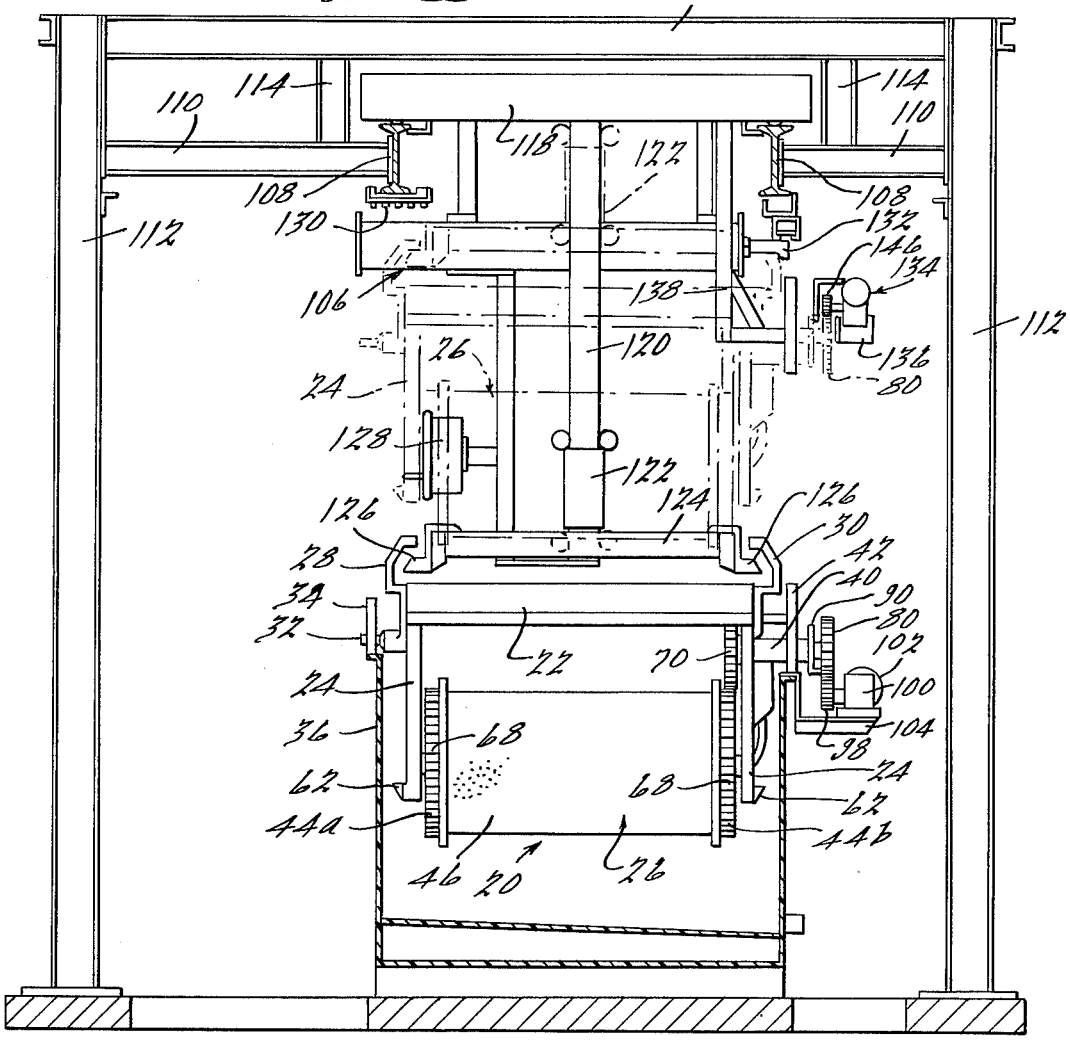
FIG. 2 is an end elevational view illustrating the work carrier of FIG. 1 immersed in a treating solution and further illustrating a typical conveyor arrangement and carriage adapted to raise and lower the work carrier and longitudinally transfer the carrier in a preselected ordered sequence between the plurality of treating stations.

Referring now in detail to the drawings and as may be best seen in FIGS. 1–4, the apparatus of the present invention includes a transportable work carrier 20 comprising a generally inverted U-shaped framework 22 including a pair of spaced apart hanger arms 24 between which a treating barrel 26 is supported for oscillation about a substantially horizontal axis. A pick-up arm 28 having a pair of spaced apart inwardly projecting V-shaped lugs is securely fastened, such as by bolting, to one of the hanger arms or supports 24, and a second pick-up arm 30 having a similar upper engaging portion is securely fastened, such as by bolting, to the outer face of the other hanger support 24. The pick-up arm 28, as best seen in FIG. 2, is formed with a lateral projection or lug 32 which is adapted to be disposed in seated engagement in a saddle 34 of a generally U-shaped configuration secured adjacent to the upper edge of a treating receptacle or tank 36 for supporting the work carrier in appropriate vertical and transversely aligned relationship with respect to the treating solution therein. In the specific embodiment shown in FIG. 2, the lug 32 is of an electrically conductive material, such as copper, for example, and the saddle 34 is suitably connected to a source of electric energy for supplying a direct current of the appropriate polarity to dangler electrodes 38 projecting inwardly of the barrel through the center of the end members, as best seen in FIG. 1, for electrifying the workpieces as may be required or desired during the performance of an electrochemical treatment thereof.

The pick-up arm 30, as best seen in FIGS. 1 and 2, is formed with a laterally extending integrally cast housing 40 having a Y-shaped web projecting upwardly thereof, which is adapted to become slidably disposed within a U-shaped saddle 42 secured on the upper edge of the tank 36 for similarly supporting the carrier in appropriate vertical and transversely aligned relationship at the treating station.

The treating barrel 26, as best seen in FIGS. 1–4, is comprised of a pair of spaced apart substantially circular end members 44*a*, 44*b*, which in accordance with the preferred embodiment, are each provided with a circular gear integrally molded therewith. A foraminous body panel 46 extends between and is fused to the inner surfaces of the end members, defining in combination therewith a generally cylindrical treating chamber. The body panel 46 in the specific embodiment shown is of a substantially circular transverse cross sectional configuration and is formed with a V-shaped tumbling rib 48 extending longitudinally therealong which projects into the treating chamber and is disposed substantially diametrically opposite to an elongated opening 50. The circumferential width of the elongated opening is preferably controlled at about 1/6 of the circumference of the body panel and preferably from about 1/10 to about 1/20 of the circumference of the treating chamber. The longitudinal edges of the opening 50 are reinforced by means of stringers 52, as best seen in FIG. 1. The elongated opening 50 provides access to the treating chamber for introducing workpieces into and for discharging workpieces from the barrel at the completion of a prescribed treating sequence. The V-shaped tumbling rib 48 imparts a cascading action to the workpieces in response to oscillation of the barrel. The sloped side faces of the tumbling rib are preferably controlled at an angle of about 10° up to about 60° relative to a tangent to the periphery of the body panel at the point of initiation of the rib, and preferably within the range of about 20° to about 40°. While only one tumbling rib is shown, it will be appreciated that two or more tumbling ribs can be provided to provide the desired tumbling or cascading action to the workpieces as may be desired. The foraminous structure of the body panel can be suitably provided by a pluality of perforations extending therethrough to facilitate entry and drainage of treating solution from the barrel and circulation of solution while the barrel is immersed in a treating tank.

Figure 3:
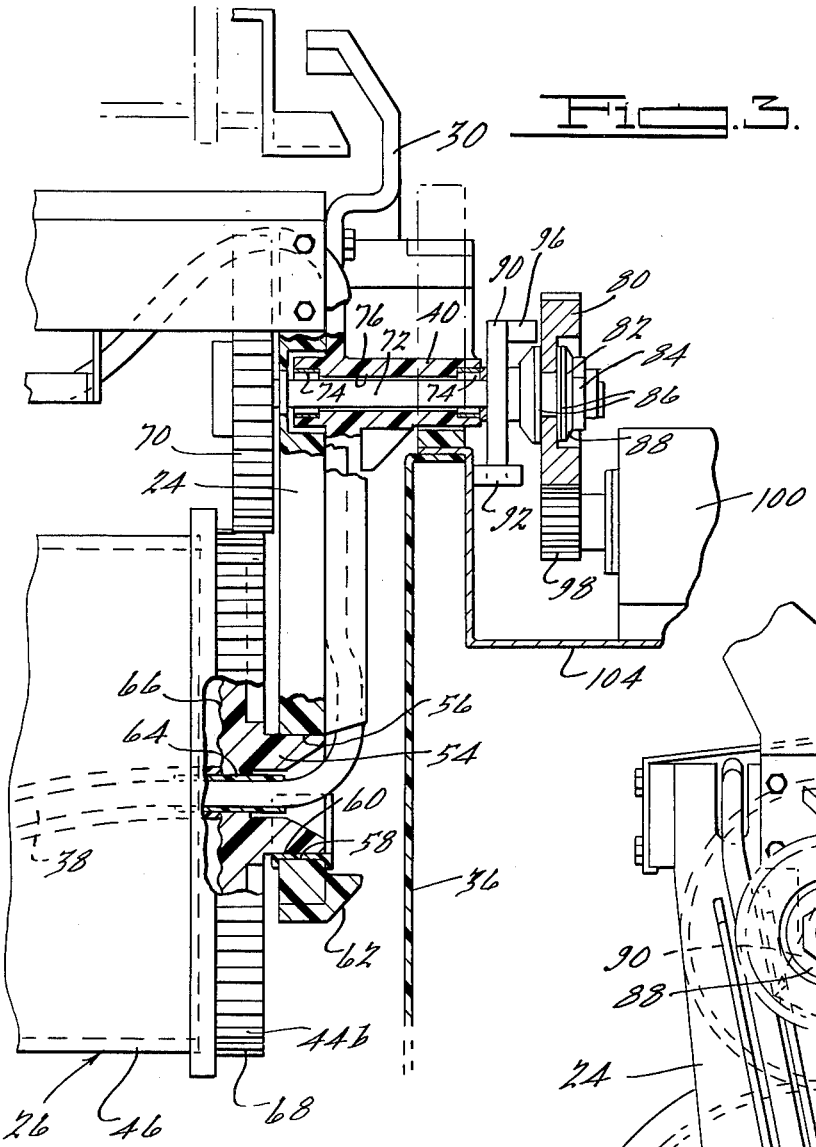
FIG. 3 is an enlarged fragmentary side elevational view of the carrier and drive mechanism mounted adjacent to a treating receptacle.

Each of the end members, as may be best seen in FIG. 3, is integrally formed with a stub shaft 54 projecting axially outwardly at substantially the center thereof, which projects into a bore 56 provided in the lower end of the hanger support 24. The lower portion of the bore 56 is undercut through an angularity of about 180°, as indicated at 58 in FIGS. 3 and 4, in which a semicircular flanged bearing, such as of Teflon indicated at 60, is removably seated for slidably supporting the barrel and the workpieces therein. Each of the hanger supports 24 are preferably composed of fiberglass reinforced polypropylene and furthermore are molded with an angularly inclined cam member 62 at the lower portion thereof for transversely guiding the work carrier assembly during its descending movement into a treating tank. The cam surface is adapted to coact with the upper edge of a treating receptacle causing the carrier to move transversely into appropriate alignment between the tank side walls.

The provision of the stub shaft 54 as opposed to prior art arrangements provides a direct downward pull on the hanger supports, eliminating a torsional couple as previously encountered in prior art structures in which a stub shaft was provided on the hanger support itself projecting inwardly into supporting relationship in a bore formed in the end wall of the barrel end member. The arrangement as shown further provides for simple replacement of the flanged semicircular bearing 60 by simply unbolting either one or both of the hanger supports enabling lateral movement thereof out of engagement with the stub shaft on the barrel, whereby the flanged bearing can be distorted and removed from the undercut section 58 and replaced with a new bearing.

Referring again to FIG. 3, the stub shaft 54 of the barrel is formed with an axial bore extending through the center thereof, through which the dangler electrode 38 extends and is preferably provided with a sleeve of a low-friction material, such as polytetrafluoroethylene, for example, indicated at 64. The inner surface of the barrel including the inner surfaces of the end members can suitably be provided with a textured or undulating surface, such as indicated at 66 in FIG. 3, which reduces the tendency of small parts to adhere to the barrel surfaces.

The entire barrel assembly, in accordance with the present invention, is preferably of a fused construction providing for substantially increased strength and dimensional stability. The outer surface of each of the end members 44*a*, 44*b*, is also preferably provided with an integral circular ring gear 68, one of which is adapted to be disposed in constant meshing relationship with a driven gear 70, rotatably supported on the inner end of a shaft 72 extending through the housing 40. In accordance with the specific improved barrel arrangement as shown, no metal parts other than the workpieces are immersed in the treating solution in that the barrel, ring gears and driven gear, along with the hanger supports 24, are comprised of a suitable alkali and acid-resistant plastic material of which polypropylene constitutes a preferred plastic.

The mechanism by which an appropriate oscillating movement is imparted to the barrel will now be described with particular reference to FIGS. 1–4 of the drawings. As perhaps best seen in FIG. 3, the drive shaft 72 is supported by bearings 74 mounted within the through bore 76 of the housing 40 and to the inner end of which shaft, the driven gear 70 is securely affixed such as by a key. A drive gear 80 is affixed to the outer end of the drive shaft through a disc-type clutch 82, which is presettable to slip at a preselected torque by means of an adjustment nut 84 threadably mounted on the end thereof. The radial web of the drive gear 80 is mounted between annular friction pads 86 which are clamped against the web of the drive gear under a preselected pressure as established by the adjustment of the nut bearing against Bellville-type springs 88. It will be appreciated that alternative type clutch arrangements can be employed for causing slippage of the drive shaft relative to the drive gear above a preselected torque for the purposes and in a manner as subsequently to be described.

Figure 4:
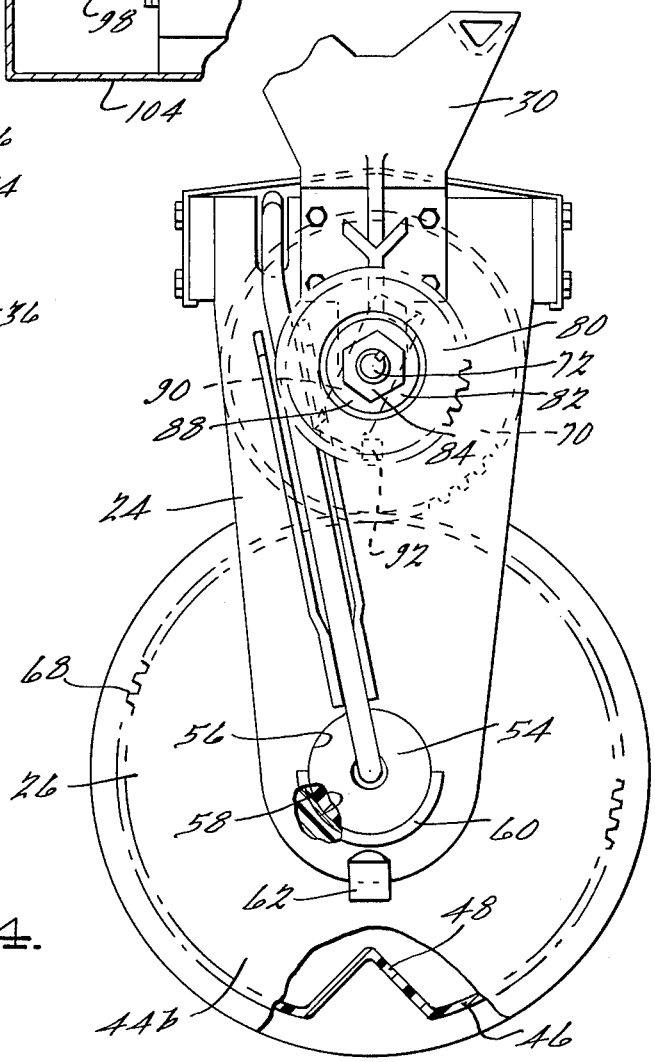
FIG. 4 is an end elevational view of the work carrier as shown in FIG. 3.
Figure 10:
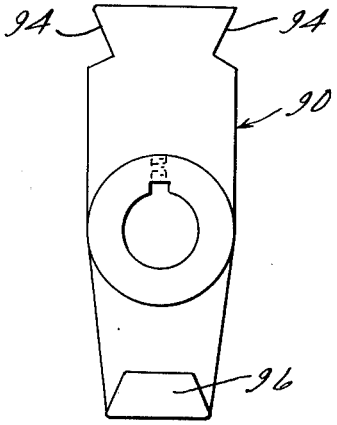
FIG. 10 is an end elevational view of the engaging arm.
Figure 11:
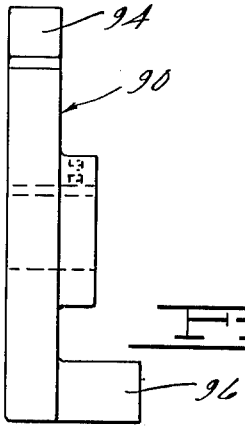
FIG. 11 is a side elevational view of the engaging arm shown in FIG. 10.

A stop or engaging arm 90 is affixed on the drive shaft, such as by keying, and is formed such that one end thereof is adapted to engage an abutment or stop member 92 affixed to and projecting laterally of the upper edge of the treating tank, as best seen in FIGS. 3 and 4. The stop arm, as illustrated in FIGS. 10 and 11, is formed with one end incorporating opposed notches 94, which are adapted to engage the abutment 92 on the tank, while the opposite end thereof is formed with a laterally extending lug 96 for engaging a secondary stop member when the barrel is in the raised position as subsequently to be described. As will be noted, the length of the notched end of the engaging arm is greater than the end formed with the lug 96, such that the lug end rotates and passes in clearance relationship with respect to the upper end of the abutment 92 as shown in FIG. 3. In accordance with the foregoing arrangement, the drive shaft and the driven gear can be rotated through an angularity slightly less than 360° in opposite directions before the notches 94 coact with the abutment stopping further angular rotation of the barrel. In this regard, it will be noted that the engaging arm 90 is oriented on the drive shaft such that the notched end thereof is positioned substantially at the center of the elongated opening 50 in the barrel when the elongated opening and barrel is disposed centrally of a vertical plane passing through the axis of rotation of the treating barrel. In accordance with this arrangement, the angularity of oscillation and the disposition of the opening at the extreme position of each oscillating movement will be substantially symmetrical about a vertical plane passing through the axis of the barrel rotation.

It has been found in order to provide efficient treatment of most small workpieces, particularly during the performance of an electroplating operation thereon, that the angle of oscillation of the barrel be at least about 180° up to an angle below that at which the workpieces are inadvertently discharged out of the elongated barrel opening. In view of the foregoing, the pitch diameter or circumference of the driven gear 70 and the ring gear 68 is controlled such that an angularity of oscillation of the treating barrel of about 180° is effected in response to rotation of the driven gear through an angularity substantially approaching 360° as limited by the engaging arm and abutment. A driven gear, for example, incorporating 44 teeth when disposed in meshing relationship with a ring gear incorporating 76 teeth providing a ratio of about 0.58 provides for satisfactory angularity of oscillation of the treating barrel when the driven gear is rotated through an angularity of about 350°.

It will be further noted that in accordance with the preferred embodiment, the driven gear is positioned in direct meshing relationship with the ring gear. It is also contemplated, however, that a suitable intervening idler gear can be provided for transferring the rotary movement of the driven gear to the barrel. The arrangement, however, as shown is preferred in that the increased diameter of the driven gear 70 enables the drive shaft to be located at a position above the level of the treating solution, such that no exposure of the shaft and bearings to the alkaline and acidic solutions occurs.

Oscillation of the treating barrel when disposed in the lowered position at a treating station, such as shown in FIGS. 2 and 3, is provided by a pinion gear 98 affixed to the output shaft of a speed reducer 100 which in turn is drivingly coupled to a reversible electric motor 102 supported on a platform 104 mounted on the side wall of the tank 36. The drive assembly, including the pinion gear 98, is located such that the drive gear 80 on the work carrier moves into meshing relationship with the pinion in response to the lowering movement of the work carrier into position and in engagement with the saddles 34, 42. The electric circuit connected to the reversible electric motor 102 includes a timing circuit (not shown) of any of the types well known in the art to effect a reversal in the direction of rotation thereof at prescribed time intervals, such as about 5 seconds, for example. The time period is established by the speed of rotation of the motor, the gear ratio of the speed reducer and the ratio of pitch diameters of the pinion and drive gear so as to provide a rotation of the drive shaft on the work carrier in one direction slightly greater than that necessary to cause the barrel to oscillate through its full angularity. Any overrun of the electric motor after the engaging arm engages the abutment 92 on the tank is compensated for by a slipping of the disc clutch 82. It will be appreciated that the barrel may not necessarily be oriented in a position such that the elongated opening is in a vertically aligned position at the time it is lowered into position at the treating station. Accordingly, upon engagement of the drive gear with the pinion gear, rotation of the barrel is effected in one direction and upon attaining the maximum angular disposition, the engaging or stop arm effects a stoppage thereof and the balance of the duration of time on the electric drive motor causes a slipping of the slip clutch mechanism.

It will also be appreciated that in lieu of employing a reversible drive motor and speed reducer arrangement as shown in FIGS. 2 and 3, a reciprocating rack and pinion arrangement can be satisfactorily employed for imparting an oscillating movement to the treating barrel. Alternative drive mechanisms which also can be satisfactorily employed are disclosed in U.S. Pat. No. 3,674,673, the substance of which is incorporated herein by reference.

Referring now to FIG. 2 of the drawings, the conveyance of the work carrier between the several treating stations and the lifting and lowering thereof so as to clear the edges of adjacent treating tanks is performed in accordance with the specific embodiment shown by a carriage 106 mounted for translatory movement on a pair of longitudinally extending rails 108 supported from a framework comprising side members 110 affixed to upright columns 112 and vertical members 114 secured to an upper cross beam 116. The carriage includes an upper platform 118 to which a vertical guide column 120 is secured on which a roller carriage 122 is guidably mounted for vertical movement to and from a lowered position as shown in solid lines in FIG. 2 to a raised position as shown in phantom. A transversely extending lift member 124 is affixed to the roller carriage and includes an engaging member 126 at each end thereof for engaging the inwardly projecting horns on the pick-up arms 28 and 30 of the work carrier. Reversible drive motors (not shown) are also mounted on the carriage 106 for effecting up and down movement of the left member and translatory movement of the carriage along the rails in appropriate alignment above the several treating stations. A manual control box 128 is provided for controlling the operation of the carriage manually, although normally the apparatus is automatically controlled through a computerized control system relying on various cam plates and limit switches at a section indicated at 130 beneath one of the rails which are adapted to be tripped in response to movement of the carriage to effect a prescribed operating sequence. Power is supplied to the motor mechanisms on the carriage through a cable 132, as fragmentarily shown.

It will be appreciated that the specific structural and operational features of the carriage and conveying mechanism are not critical to the appropriate performance of the improved drive mechanism stop assembly and treating barrel on the work carrier itself. It is also contemplated that transport of the barrel between one or a plurality of stations can be effected by a manually operated lift mechanism as well as by alternative manual or automatically controlled conveying devices.

The specific carriage and conveying device as shown in FIG. 2 may be of the general type as disclosed in U.S. Pat. No. 3,252,603, granted May 24, 1966, for "Shuttle Conveying Machine with Independently Elevatable Load Engaging Means", which is also assigned to the assignee of the present invention, and the substance of which is also incorporated herein by reference by way of further explanation of the structural and operating features thereof.

A structural feature of the carriage 106 as shown in FIG. 2 which is important to the present invention is the provision of a secondary up-position drive mechanism indicated at 134, which is adapted to coact with the work carrier drive mechanism for effecting a controlled oscillation of the barrel while in a raised position. The provision of such an up-position drive mechanism constitutes a preferred embodiment of the present invention in that it provides for improved drainage of treating solution from the interior of the treating barrel and from the workpieces therein. The up-position rotation of the barrel is particularly important when processing workpieces such as of a cup-shaped configuration which tend to entrap large quantities of treating solution when the barrel is withdrawn from a treating tank. By imparting an oscillating movement to the barrel while in a raised position, a tumbling or cascading of the cup-shaped workpieces is effected, causing the solution to be dumped and drained through the foraminous body of the barrel. For this purpose, the angularity of oscillating movement of the barrel can be somewhat less than 180° as is preferred when the barrel is immersed in a treating solution, up to a magnitude below that at which workpieces are inadvertently discharged from the barrel opening. The minimum angularity of oscillation will vary with the type of workpieces and should be sufficient to impart a tumbling or cascading motion to the workpieces during the course of the barrel oscillation effecting a release of the entrapped treating solution. Normally, angles of oscillation of about 150° are adequate, although oscillations preferably of at least about 180° are preferred.

Figure 5:
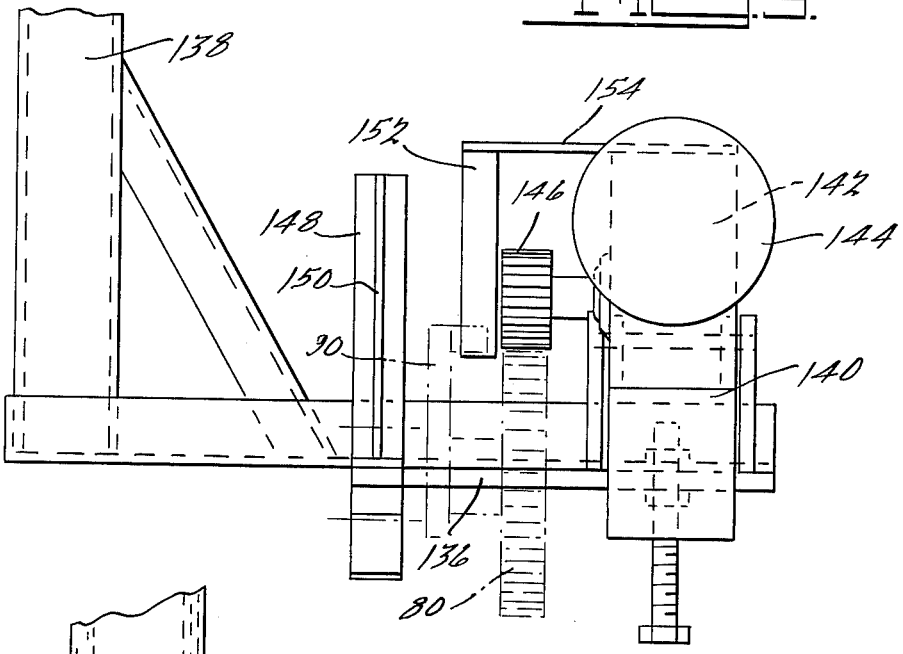
FIG. 5 is an enlarged fragmentary end elevation view of the secondary drive mechanism mounted on the conveyor carriage of FIG. 2.
Figure 6:
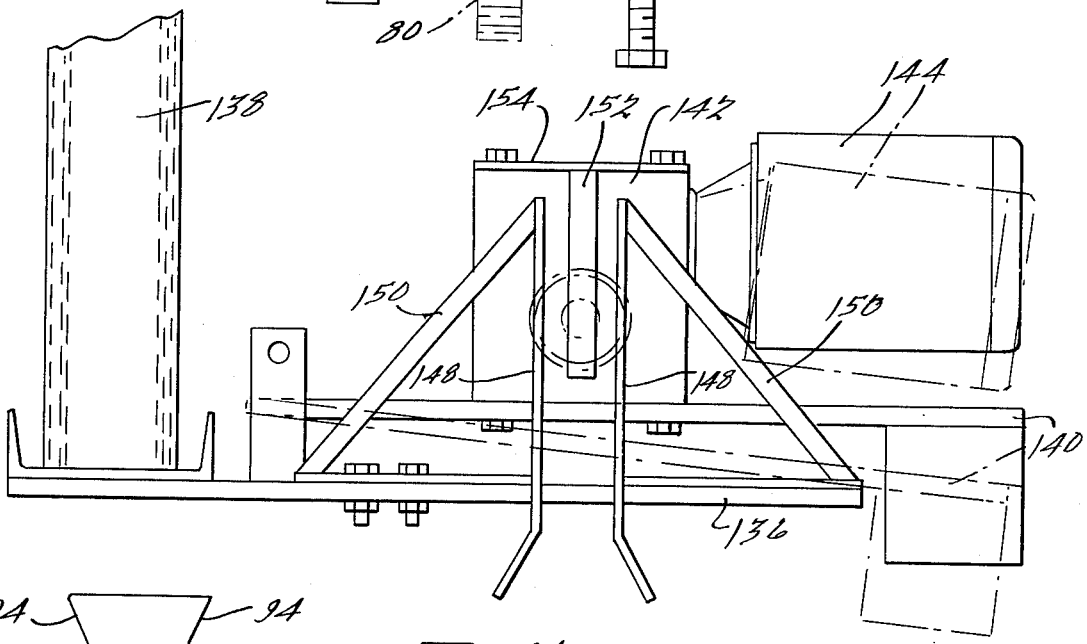
FIG. 6 is a fragmentary side elevational view of the secondary drive mechanism shown in FIG. 5.

The secondary up-position drive mechanism 134, as shown in FIG. 2 and as further illustrated in FIGS. 5 and 6, comprises a platform 136 connected by means of a vertical beam 138 to the carriage framework on which a counterweighted lever arm 140 is pivotally mounted. A speed reducer 142 is drivingly coupled to a reversible electric motor 144 and is provided with an output shaft to which a driven pinion 146 is secured. The platform, as best seen in FIGS. 5 and 6, is further provided with a vertical guide comprising a pair of spaced apart guide members 148 having a flared lower end supported by angle braces 150 for guidably receiving and aligning the housing 40 and Y-shaped flange of the work carrier as it is lifted to the elevated position as shown in phantom. Accordingly, the drive gear 80 is disposed in appropriate aligned relationship with respect to the drive pinion 146 and the pivoting action of the secondary drive mechanism on the lever arm assures appropriate vertical alignment and meshing engagement therebetween. A vertical stop or abutment 152 is affixed to a plate 154 mounted on the upper surface of the speed reducer 142 and is axially disposed so as to coact with the lug 96 on the engaging arm 90 restricting relative rotation of the barrel beyond the prescribed angularity and in a manner similar to that previously described in connection with the barrel when disposed in the lower treating position. The notched end of the engaging arm 90 being planar clears the abutment 152 and accordingly is rendered inoperative when the barrel is in the raised position. The relative disposition of the drive pinion 146 of the secondary up-position drive mechanism relative to the drive gear and engaging arm on the carriage drive mechanism when the carriage is in the raised position is shown in phantom in FIGS. 2, 5 and 6. The operation of the reversible motor 144 in the secondary drive mechanism can suitably incorporate a timer in the control circuit for imparting one or a prescribed number of oscillations to the barrel while in the raised position to effect a drainage of treating solution from the barrel in response to the barrel attaining the raised position as signaled by an appropriate limit switch, whereafter the motor is deenergized, enabling conveyance of the work carrier to the next treating station.

Figure 7:
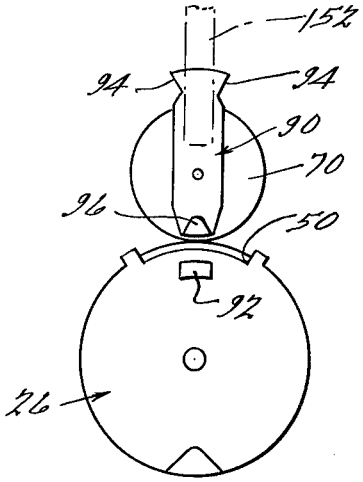
FIGS. 7–9 are diagrammatic and elevational views illustrating the geometric disposition of the abutments and engaging arm on the barrel when in an intermediate position, as well as in the extreme angular positions.
Figure 8:
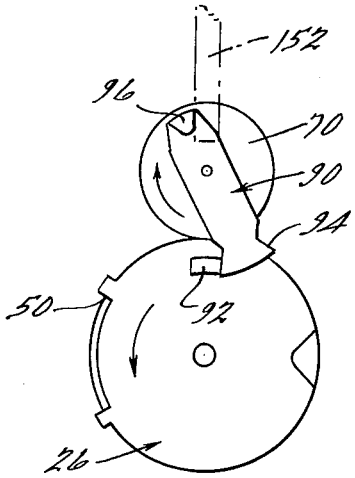
Figure 9:
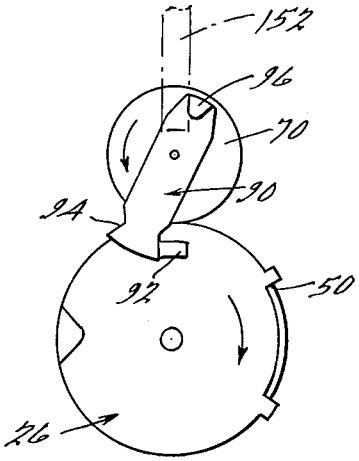

A schematic representation of the operation of the engaging arm including the notched end thereof with the abutment 92 at a tank is illustrated in FIGS. 7–9. The corresponding coaction between the lug 96 is illustrated with the abutment 152 shown in phantom. As shown in FIG. 7, the barrel is either lowered into a treating station or raised from a treating station, with the opening thereof in a substantially vertical position. The engaging arm correspondingly is in a substantially vertical position. Upon attaining the fully lowered or fully raised position, rotation of the driven gear 70 in a clockwise direction from the position shown in FIG. 7 to the position shown in FIG. 8 causes a corresponding clockwise rotation of the engaging arm 90, such that the notched end thereof coacts with the abutment 92 at the edge of a tank, stopping rotation of the barrel, with the opening 50 thereof in the position as illustrated in FIG. 8. In that position, treating solution can flow into the open portion of the barrel, effecting an improved circulation and replenishment of the chemicals therein. Thereafter, the driven gear 70 is rotated in the opposite direction, or counterclockwise, as shown in FIG. 9, effecting a corresponding clockwise rotation of the barrel until the opposite notch at the notched end of the engaging arm 90 contacts the abutment 92. A corresponding control of the angular oscillation of the barrel when in the raised position is illustrated in FIGS. 8 and 9, in which the lug 96 engages the abutment 152, as shown in phantom.

It will be appreciated that the work carrier assembly of the present invention is particularly applicable for automatic work handling systems whereby the workpieces can automatically be dumped by the action of gravity at an unload station at which no corresponding abutments 92, 152 are present, enabling the barrel to rotate beyond the normally restricted oscillating position. Normally, such unload mechanism is controlled by suitable limit switches to prevent the barrel from rotating substantially beyond an inverted position in which the opening 50 is positioned downwardly. Since the driven gear of the carriage drive mechanism and the ring gear on the barrel are carefully synchronized relative to the engaging arm to provide symmetrical oscillation of the barrel, it is important that the foregoing synchronized relationship be maintained. To avoid inadvertent continuous rotation of the driven gear and ring gear at an unload station, whereby the barrel or the driven gear are rotated in the same direction beyond one revolution thereby causing a loss of synchronization, it is preferred that a suitable stop device is incorporated to prevent such continued rotation in one direction and a corresponding loss of the synchronized relationship. A satisfactory solution to the foregoing problem in accordance with a preferred embodiment of the present invention is achieved by plugging one of the teeth of the barrel ring gear 68, such as by filling a tooth indicated at 156 in FIG. 1, causing interference between the ring gear and driven gear 70, preventing further relative rotation therebetween. Upon coaction of the plug with the driven gear, further rotation is prevented and the drive gear simply cuases the clutch 82 to slip.

Figure 12:
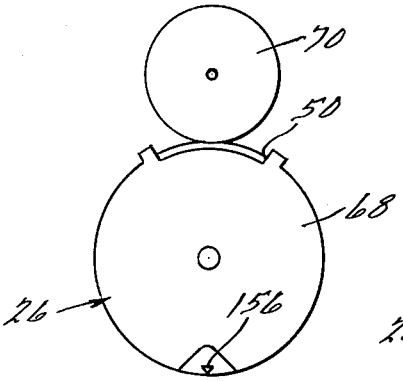
FIGS. 12–14 are diagrammatic side elevation views of the disposition of the plug on the ring gear for effecting a controlled rotation of the barrel during the unloading operation.
Figure 13:
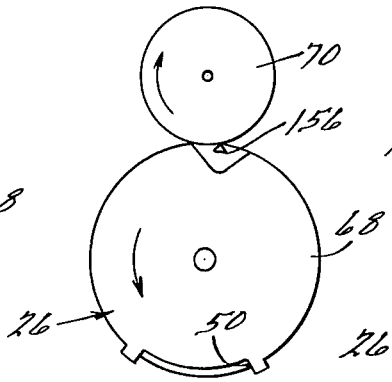
Figure 14:
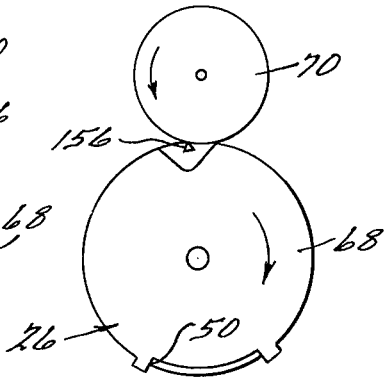
Figure 15:
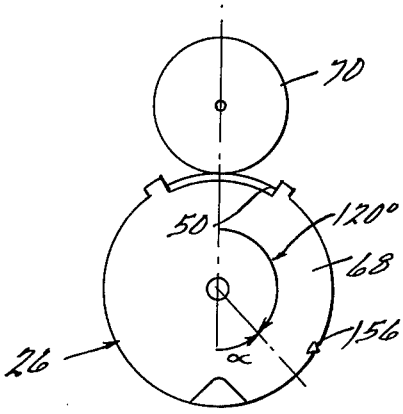
FIGS. 15–17 are diagrammatic views similar to FIGS. 12–14 illustrating an alternative position of the plug.
Figure 16:
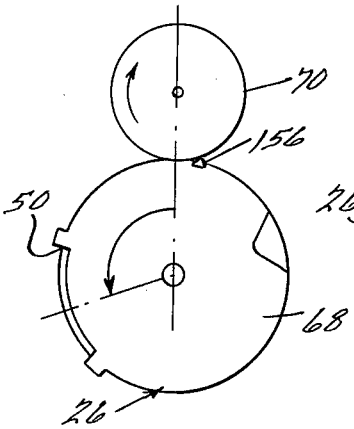
Figure 17:
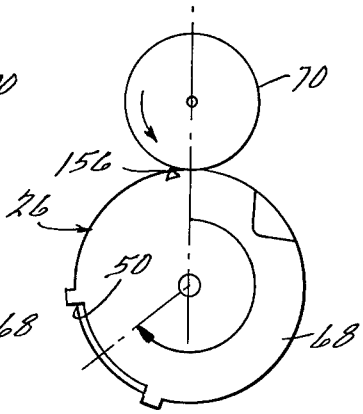

Referring now to FIGS. 12–17, the schematic relationship of the disposition of the plug 156 on the ring gear is illustrated in accordance with two alternative positions. In the arrangement as diagrammatically illustrated in FIGS. 12–14, the plug 156 in the ring gear 68 of the barrel 26 is located diametrically opposite to the center of the opening 50 of the barrel. FIG. 12 depicts the relationship in which the opening 50 is in an upright position substantially centered with respect to a vertical axis. In response to rotation of the driven gear 70 in a clockwise direction, the barrel is caused to rotate in a counterclockwise direction to a position as shown in FIG. 13 in which the plug 156 engages the driven gear, causing the opening 50 to stop at a substantially inverted position approaching 180° from the position as depicted in FIG. 12. Similarly, in response to rotation of the driven gear in a counterclockwise direction, the barrel is caused to rotate in a clockwise direction until the plug 156 coacts with the driven gear, causing the barrel to stop with the opening in a substantially inverted position as shown in FIG. 14. The disposition of the plug 156 substantially diametrically opposite to the center of the opening 50 of the barrel is normally adequate for effecting a substantially complete discharge of the workpieces from the barrel in response to two oscillating cycles of the barrel from the positions as shown in FIG. 13 to the position as shown in FIG. 14. In some instances, however, due to the nature of the workpieces and their tendency to interlock and engage the surfaces of the barrel, it is desirable to have the barrel undergo a rotation past a completely inverted position to assure substantially complete discharge of the workpieces. This latter arrangement is depicted diagrammatically in FIGS. 15–17 in which the plug 156 is disposed at an angle $\alpha$ from a position diagrammatically opposite the opening 50 of the barrel 26. In the specific arrangement as diagrammatically shown, the angle $\alpha$ is 60°. Accordingly, when the driven gear 70 is rotated in a clockwise direction, the barrel rotates in a counterclockwise direction, as viewed in FIG. 16, and wherein the opening 50 is moved from an upright position as shown in FIG. 15 to an inclined position as shown in FIG. 16. At that position, a portion of the workpieces are discharged from the opening 50 in the barrel. In response to a reversal in the direction of rotation of the driven gear 70 to a counterclockwise direction in accordance with the arrangement illustrated in FIG. 17, the barrel is caused to undergo a rotation in a clockwise direction, wherein the opening 50 passes beyond a completely inverted position to a position of about 60° beyond the vertical, as shown in FIG. 17. Upon a return of the opening to the upright position, as shown in FIG. 15, preparatory to loading of workpieces, the opening 50 of the barrel again passes through the completely inverted position, assuring a gravitational discharge of substantially all of the workpieces therein. It will be appreciated, in accordance with the arrangements shown in FIGS. 12–17, that the plug 156 can advantageously be positioned at an angle $\alpha$ of about zero in accordance with the disposition depicted in FIG. 12 up to angle $\alpha$ of about 60° as depicted in FIG. 15, which can be varied to optimize the dumping action of the barrel consistent with the type of parts being processed. As in the case of the treating station, the drive mechanism at the unload station includes a timer to control the driving motion of the barrel through at least one cycle in each direction before returning the barrel to an upright load position.

While it will be apparent that the invention herein described is well calculated to achieve the benefits and advantages set forth above, it will be appreciated the invention is susceptible to modification, variation and change without departing from the spirit thereof.

What is claimed is:

1. A work carrier for treating articles in bulk comprising a framework, a foraminous treating barrel defining a generally cylindrically-shaped internal treating chamber and formed with a longitudinally extending opening in communication with said chamber, means for rotatably mounting said barrel at its ends to said framework for rotation about a horizontal axis extending substantially longitudinally and centrally of said chamber, a ring gear on one of the ends of said barrel, a drive assembly including drive shaft means rotatably supported on said framework having driven gear means on one portion thereof disposed in meshing relationship with said ring gear and drive gear means on another portion thereof adapted to be disposed in meshing relationship with external reversible drive means to effect an oscillating movement of said barrel when disposed at a treating station, an engaging member affixed to said shaft means including engaging means thereon for engaging an external abutment when said carrier is disposed at a treating station to restrict oscillating movement of said barrel beyond a preselected angularity, and yieldable coupling means associated with said drive assembly and said reversible drive means adapted to yield when said engaging means is disposed in stopping relationship with said abutment.

2. The work carrier as defined in claim 1, in which said engaging member includes second engaging means for engaging a second external abutment when said work carrier is disposed at an elevated position above a treating station in which said drive gear means thereon is disposed in meshing relationship with a second external reversible drive means to restrict oscillating movement of said barrel beyond a preselected angularity.

3. The work carrier as defined in claim 1, in which said ring gear includes interferring means preventing unrestricted relative rotation of said ring gear and said driven means in either direction beyond a preselected position.

4. The work carrier as defined in claim 3, in which said interferring means comprises a plug interposed between teeth of said ring gear causing a meshing interference between said ring gear and said driven gear means.

5. The work carrier as defined in claim 3, in which said interferring means is located on said ring gear at a position substantially diametrically opposite to said opening in said barrel.

6. The work carrier as defined in claim 3, in which said interferring means is located on said ring gear at a position angularly spaced from about 120° to about 180° from the center of said opening in said barrel.

7. The work carrier as defined in claim 1, in which said engaging means and said abutment are oriented to provide oscillating movement of said barrel through substantially the same angularity in either direction.

8. The work carrier as defined in claim 1, in which said engaging means and said abutment are oriented to provide oscillating movement of said barrel through an angularity of from about 180° up to an angularity below that at which articles are inadvertently discharged from said chamber through said opening.

9. The work carrier as defined in claim 1, in which said driven gear means comprises a gear having a pitch diameter of at least about one-half the pitch diameter of said ring gear.

10. The work carrier as defined in claim 9, in which said pitch diameter of said driven gear means is about 0.6 times the pitch diameter of said ring gear.

11. The work carrier as defined in claim 1, in which said shaft means comprises a unitary shaft rotatably journaled on said framework and said engaging member comprises an arm affixed to said shaft and projecting laterally thereof.

12. The work carrier as defined in claim 1, in which said yieldable coupling means is interposed between said shaft means and said drive gear means.

13. The work carrier as defined in claim 1, in which said yieldable coupling means comprises a disc-type clutch.

14. The work carrier as defined in claim 2, in which said engaging member comprises an engaging arm projecting laterally of said shaft means and including two diametrically disposed end portions, said engaging means formed on one of said end portions and said second engaging means formed on the other of said end portions, said engaging means positioned to be disposed in clearance relationship with respect to said second abutment when said carrier is in the elevated position and said second engaging means positioned to be disposed in clearance relationship with respect to said abutment when said carrier is disposed at a treating station.

15. The work carrier as defined in claim 1, further including coacting means on said framework for guidably positioning said carrier at a treating station with said drive gear means disposed in meshing relationship with said reversible drive means.

16. In a work carrier for treating articles in bulk, the combination comprising a framework including a pair of depending spaced-apart support arms and a foraminous treating barrel supported for oscillating movement between said support arms, said barrel comprising a pair of spaced apart end members and a body panel extending therebetween and defining in combination an internal substantially cylindrically-shaped treating chamber, each of said end members integrally formed with a shaft projecting axially outwardly from substantially the center of the exterior faces thereof, each said support arm formed with a bore for slidably receiving and rotatably journaling each said shaft, and a bearing member interposed between said shaft and said bore in said support arm for supporting said barrel for rotation relative to said framework.

17. The work carrier as defined in claim 16, in which said barrel is comprised of a heat-fusible plastic and wherein said end members and said body panel are joined through a fused connection.

18. The work carrier as defined in claim 16, in which at least one of the shafts on the end members is provided with an axial bore extending into said treating chamber, and an electrical conductor disposed in said bore and projecting inwardly of said chamber.

19. The work carrier as defined in claim 16, in which said bearing member comprises a flanged half bearing overlying the lower one-half portion of said bore in said support arm.

20. The work carrier as defined in claim 19, in which said bore is recessed along its lower one-half portion for slidably receiving said flanged half bearing.

* * * * *